US005600087A

United States Patent [19]

Chace, Jr.

[11] Patent Number: 5,600,087

[45] Date of Patent: Feb. 4, 1997

[54] FIELD PROGRAMMABLE EXPENDABLE UNDERWATER VEHICLE

[75] Inventor: Raymond A. Chace, Jr., East Freetown, Mass.

[73] Assignee: Sippican, Inc., Marion, Mass.

[21] Appl. No.: 408,559

[22] Filed: Mar. 21, 1995

[51] Int. Cl.[6] ..... F42B 19/36

[52] U.S. Cl. ..... 114/20.1; 114/20.2

[58] Field of Search ..... 114/20.1, 20.2, 114/21.1, 21.2; 244/3.15

[56] References Cited

U.S. PATENT DOCUMENTS

| | | | |
|---|---|---|---|
| 2,938,483 | 5/1960 | Mason . | |
| 2,975,396 | 3/1961 | Mueller | 340/5 |
| 3,130,384 | 4/1964 | Downs et al. . | |
| 3,180,295 | 4/1965 | Niederer | 114/20.1 |
| 3,609,671 | 9/1971 | Webster et al. | 340/3 E |
| 3,676,802 | 7/1972 | Murphree et al. | 340/384 E |
| 3,875,552 | 4/1975 | Hogman et al. . | |
| 3,921,559 | 11/1975 | Wells, Sr. | 114/20 |
| 4,198,703 | 4/1980 | Huisveld, Jr. et al. | 367/1 |
| 4,553,718 | 11/1985 | Pinson | 244/3.15 |
| 4,560,228 | 12/1985 | Bender . | |
| 4,632,031 | 12/1986 | Jarrott et al. . | |
| 4,660,170 | 4/1987 | Hui et al. . | |
| 5,048,771 | 9/1991 | Siering | 244/3.15 |
| 5,096,139 | 3/1992 | Feld et al. | 244/3.15 |
| 5,144,587 | 9/1992 | Mason . | |
| 5,247,894 | 9/1993 | Haisfield et al. | 114/20.1 |
| 5,319,556 | 6/1994 | Bessacini | 89/1.81 |
| 5,458,042 | 10/1995 | Cante | 89/1.813 |
| 5,487,350 | 1/1996 | Chace, Jr. et al. | 114/330 |
| 5,490,473 | 2/1996 | Chace, Jr. et al. | 114/330 |

FOREIGN PATENT DOCUMENTS

| | | |
|---|---|---|
| 0149778 | 7/1985 | European Pat. Off. . |
| 0432902A2 | 6/1991 | European Pat. Off. . |
| 2240690 | 2/1974 | Germany . |

OTHER PUBLICATIONS

Revue Internationale De Defense, vol. 13, No. 3, 1980, Geneva, p. 424, XP002003435 "La Cible Sous–Marine MK30 MOD 1".

Soldat und Technik, vol. 37, No. 5, May 1994, Frankfurt am Main, pp. 260–262, XP000452312 Kronke; "A Submarine Simulating Underwater Target Apparatus".

*Primary Examiner*—Michael J. Carone
*Assistant Examiner*—Theresa M. Wesson
*Attorney, Agent, or Firm*—Testa, Hurwitz & Thibeault, LLP

[57] ABSTRACT

An expendable underwater vehicle for use in training naval forces in anti-submarine warfare in ocean waters is between about three to five feet in length and about five inches in diameter, and it is field programmable. The expendable underwater vehicle can be programmed in the field at the location where the vehicle actually will be used as a training device. A system for field programming the vehicle comprises a run geometry generator and a portable interface module. The run geometry generator downloads the operational parameters to the portable interface module, and the portable interface module then downloads the operational parameters into the vehicle. These operational parameters are stored in the vehicle and then used by the vehicle during an in-water run.

6 Claims, 4 Drawing Sheets

FIELD PROGRAMMABLE EXPENDABLE UNDERWATER VEHICLE

FIELD OF THE INVENTION

This invention relates to expendable underwater vehicles, and more particularly, field programmable expendable underwater vehicles.

BACKGROUND OF THE INVENTION

An expendable underwater vehicle, such as the Expendable Mobile ASW (Anti-Submarine Warfare) Training Target (EMATT) which is available from Sippican, Inc. of Marion, Mass., is used to train naval forces in the detection, localization, tracking, and/or attack of a submarine in the ocean (i.e., to train naval forces in anti-submarine warfare). After being launched into the ocean, the expendable underwater vehicle "swims" a pre-programmed underwater course at a relatively constant speed (e.g., between 8 and 9 knots) as it acoustically simulates a submarine. The naval forces use acoustics to detect, localize, track, and/or attack the simulated submarine. After a specified time, currently about three hours, the internal batteries of the expendable underwater vehicle become exhausted, and the vehicle drops to the bottom of the ocean.

The expendable underwater vehicle can be launched into the ocean from, for example, either a surface ship or an aircraft. When launched by a surface ship, the expendable underwater vehicle is dropped into the water, usually from a short distance thereabove such that the impact is minimal and no damage results. In an aircraft launch, the expendable underwater vehicle cannot simply be dropped into the water because the impact with the water typically will damage the vehicle. Additional hardware is used in an aircraft launch to help the vehicle survive the impact with the water. The additional hardware typically is referred to collectively as an air launch assembly.

To air launch the expendable underwater vehicle, it is fitted with the air launch assembly, and then the combination typically is packaged in a sonobuoy launch container. The vehicle then can be launched from the aircraft either by using a launching tube on the aircraft that accepts the sonobuoy launch container and automatically upon command ejects the vehicle from the container, or by manually removing the vehicle from the sonobuoy launch container and dropping (launching) the unit through a launching tube or other opening in the aircraft. After the vehicle is launched from the aircraft, the air launch assembly deploys and decelerates the vehicle such that the vehicle enters the water nose-first and along its longitudinal axis.

SUMMARY OF THE INVENTION

The invention relates to an expendable underwater vehicle for use in training naval forces in anti-submarine warfare in ocean waters. The vehicle is between about three to five feet in length and about five inches in diameter, and it is field programmable which makes it very versatile and useful.

In accordance with the invention, a field programmable system is provided. This system allows the expendable underwater vehicle to be programmed in the field at the location where the vehicle actually will be used as a training device. The system comprises a portable interface module which, when coupled to the expendable underwater vehicle, downloads operational parameters into the vehicle. These parameters which are transferred from the module to the vehicle are stored in the vehicle and are then used by the vehicle during an in-water run.

The portable interface module typically is carried to the location of the vehicle prior to launch of the vehicle, and the interface module is then hooked to the vehicle to allow communication therebetween, e.g., to allow downloading of the operational parameters from the module to the vehicle. Once the downloading is complete, the portable interface module can be decoupled from the vehicle, and the vehicle is then ready to be launched into the water. Typically, the portable interface module receives and stores the operational parameters (for later downloading to the expendable underwater vehicle) from a "run geometry" generator. This generator preferably is a computer which allows creation and modification of files containing the operational parameters. After receiving and storing the operational parameters from this computer, the portable interface module can be decoupled therefrom and transported to the site of the vehicle for downloading of the parameters to the vehicle in accordance with the invention.

The field programmability feature provided by the invention makes the expendable underwater vehicle a very flexible and useful training device. For example, naval forces desiring to train in the open ocean but not wanting to deviate from their ship's current course can program the vehicle prior to its launch to follow the course of the ship. This will allow the naval personnel aboard the ship to train without delaying the ship's arrival at its intended destination.

The foregoing and other objects, aspects, features, and advantages of the invention will become more apparent from the following description and from the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DESCRIPTION

Figure 1:
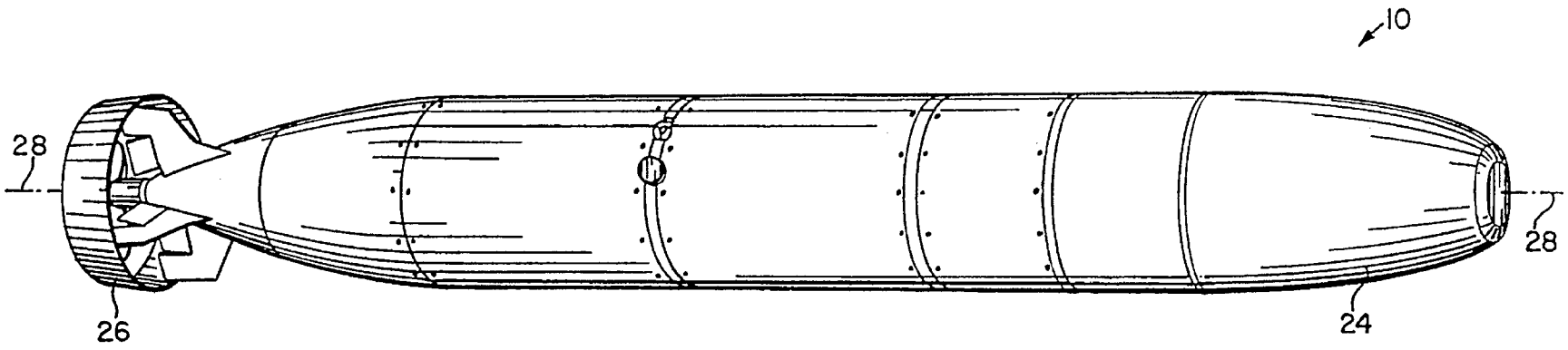
FIG. 1 is a perspective view of an expendable underwater vehicle.
Figure 2:
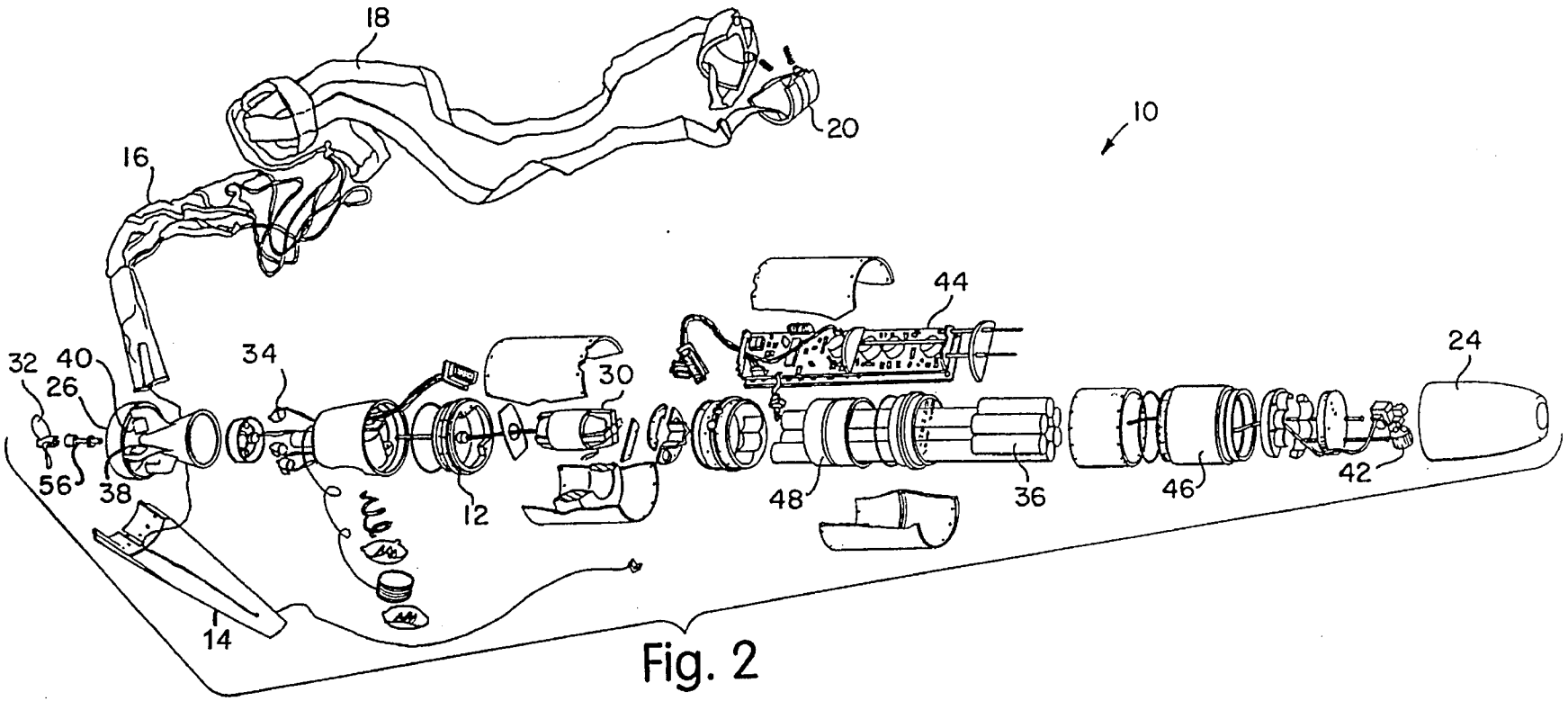
FIG. 2 is an exploded perspective view of the expendable underwater vehicle of FIG. 1, and an air launch assembly for use therewith.

Referring to FIGS. 1 and 2, an expendable underwater vehicle 10, such as an Expendable Mobile ASW (Anti-Submarine Warfare) Training Target (EMATT) which is available from Sippican, Inc. of Marion, Mass., is a battery-powered, self-propelled unit which is about three feet long, about five inches in diameter at its thickest point, and about twenty-five pounds in weight. The vehicle is occasionally referred to herein as a target. The vehicle can range up to about five feet in length. In ASW training exercises, the vehicle 10 is used to simulate a submarine, and it performs a three-hour pattern with varying headings and depths. After being launched into the water, the vehicle 10 turns on and "swims" when a pressure switch 12, mounted on the hull of the vehicle 10, closes. The pressure switch 12 closes when the negatively buoyant vehicle 10 sinks below a specified depth, currently thirty feet. The closing of the pressure switch 12 causes battery power to be provided to the vehicle 10.

The vehicle 10 includes a nose 24 at a front end and a shroud 26 at a rear end. Between the nose 24 and the shroud 26 is a generally watertight compartment which houses a DC motor 30 for driving a propeller 32, a guidance and control subsystem for implementing a preprogrammed course for the vehicle in the ocean by controlling the motor 30 and solenoids 34 to cause the vehicle to follow the course, a signal processing subsystem, and a battery pack 36 for supplying power to the signal processing subsystem, the guidance and control subsystem, the motor 30, and the solenoids 34. The battery pack 36 preferably includes one or more lithium batteries (e.g., $LiSO_2$), although in general other power sources can be used such as one or more non-lithium batteries (e.g., Mg-AgCl Seawater). The solenoids 34 are actuators which move elevators 38 and rudders 40 at the command of the guidance and control subsystem.

The guidance and control subsystem includes a fluxgate compass 42, the pressure switch 12, the solenoids 34, and electronics 44. The signal processing subsystem simulates a submarine by generating signals representative of the submarine and causing corresponding acoustic signals to be transmitted into the ocean. The signal processing subsystem includes the electronics 44, a forebody projector 46, and at least one midbody projector 48. The forebody projector 46 is an acoustic transducer which, under the control of the electronics 44, receives acoustic interrogations from an external source (e.g., from a sonobuoy or some other active sonar system) and then transmits acoustic signals representative of echoes which the submarine would return. The forebody projector 46 thus is an active echo receiver/repeater. The midbody projectors 48 are acoustic transducers which, under the control of the electronics 44, generates "noise" which simulates the sound of the running submarine. The midbody projectors 48 thus generate a passive acoustic signature of the simulated submarine.

The vehicle 10 can be launched either from a surface ship by manually dropping it into the water or from an aircraft by using additional hardware. In one embodiment, the additional hardware used in an air launch includes a windflap 14, a parachute 16, a harness 18, and a nose cup assembly 20.

The vehicle 10 can be air launched from an aircraft by loading it into and then firing it out of a sonobuoy launch container (SLC) or from a gravity tube on the aircraft. Prior to loading the vehicle 10 into the sonobuoy launch container, the nose cup 20 is placed over the nose 24, and the harness 18 is releasably secured to the cup and extends on either side of the vehicle 10 along its length to the shroud 26. The parachute 16 is tucked in around the shroud 26 and then the windflap 14 is put in place such that the entire assembly fits into the sonobuoy launch container. Once the vehicle 10 is launched out of the sonobuoy launch container and into the air, the windflap 14 deploys the parachute 16 and, in so doing, the windflap 14 separates from the vehicle 10 while the vehicle 10 is in flight. The deployed parachute 16 then decelerates the vehicle 10 and causes it to enter the water nose-first and along its longitudinal axis 28.

In the air launch configuration which uses the nose cup assembly 20, while the vehicle 10 is in flight, a release band helps to secure the harness 18 to the cup assembly 20 while the vehicle 10 is in flight. Upon water impact, a plunger in the face of the cup assembly 20 is depressed by the force of the impact, and the release band is thereby released allowing the harness 18 and the parachute 16 to disconnect from the vehicle 10. The cup assembly 20 bears the brunt of the impact, which impact typically is strong enough to damage the nose 24 if the nose 24 is unprotected (e.g., if the cup assembly 20 is not fitted over the nose 24).

Figure 3:
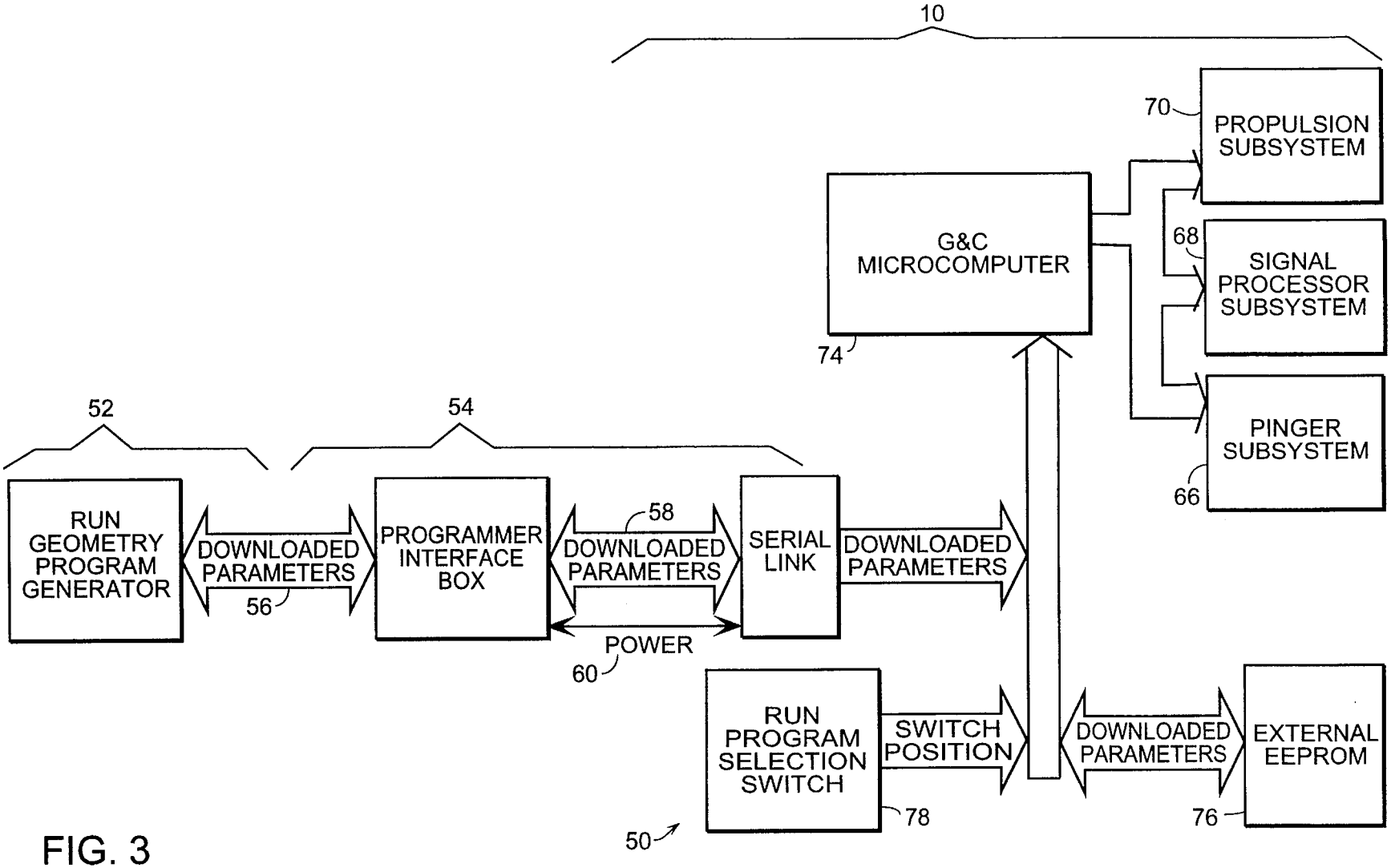
FIG. 3 is a block diagram of a field programmable system in accordance with the invention.
Figure 4:
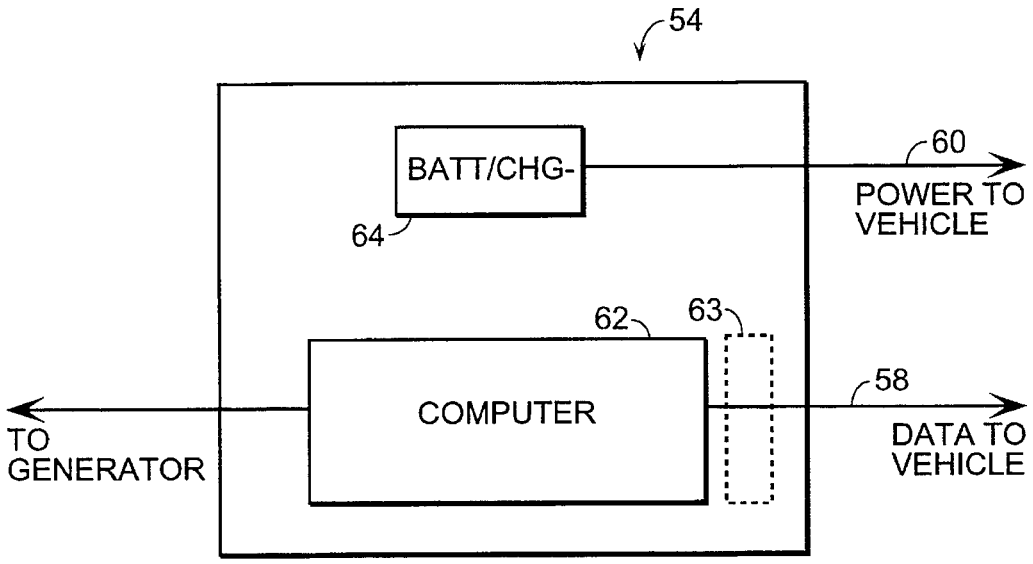
FIG. 4 is a block diagram of a portable interface module shown in FIG. 3.

Referring to FIGS. 3 and 4, a field programmable system 50 according to the invention includes a portable interface module or box 54. The box 54 is couplable to the expendable underwater vehicle 10 to program the vehicle 10 "in the field", i.e., at the location where the vehicle 10 actually will be used as a training device such as on board the naval ship or in the aircraft which will launch the vehicle 10 into the water. The box 54 downloads operational parameters into the vehicle 10 when coupled thereto, and stores the parameters in the vehicle 10. The box 54 also can determine the parameters currently stored within the vehicle 10. The vehicle 10 uses the parameters during an in-water training run. The parameters can include heading, depth, speed, tonal levels, etc. information which will determine the vehicle's movement/operation during an in-ocean training run.

In a typical scenario, the box 54 is first coupled to a run geometry generator 52 which downloads the desired operational parameters into the box 54. The box 54 typically is not connected to the vehicle 10 during this download from the generator 52. The box 54 is then decoupled from the generator 52 and transported to the location of the vehicle 10. Once coupled to the vehicle 10, the box 54 can download the operational parameters, which it received from the generator 52 and stored, into the vehicle 10. The box 54 is then decoupled from the vehicle 10, and the vehicle 10 is ready to be used for training.

The generator 52 allows an operator to create and modify files containing the operational parameters. This creation and/or modification typically is performed by the operator when the box 54 is not connected to the generator 52. The generator 52 can be located, for example, on the naval ship or at a naval land base. The generator 52 preferably is a personal computer or workstation (e.g., an IBM PC or compatible or an Apple computer), and the creation and modification of parameter files is accomplished with a specially-designed application program running on the computer. When it is desired to download the created and/or modified operational parameter data from the generator 52, the portable box 54 is brought to the generator 52 and coupled to the generator 52 via a communications link 56, preferably a serial data link.

The portable interface box 54, in a preferred embodiment, comprises a palmtop computer 62 and a battery/charger 64 which are both housed within the box 54. The box 54 is lightweight, about 10 pounds in a preferred embodiment, and therefore easy for a single person to carry and operate. Its dimensions also contribute to its portability and ease of use, and those dimensions in a preferred embodiment are about 1 foot wide across the front, 1 foot high from top to bottom, and 0.5 feet deep from front to back (i.e., 0.5 cubic feet or 864 cubic inches).

In a preferred embodiment, the palmtop computer 62 of the box 54 uses the DOS operating system, and it includes one or more processors and memory. In place of the palmtop computer 62 in the box 54, it is possible to use another type of computer or processor or to use dedicated electronics. Whatever is used in the box 54, it preferably either allows the preferred weight and size values of the box 54 (given above) to be substantially maintained or allows the box 54 to be even smaller and/or lighter than the preferred values. It is desirable to make the box 54 as easy as possible to carry and operate.

When the box 54 is coupled to the vehicle 10 in order to download parameters thereto, the box 54 typically is not also connected to the generator 52. The box 54 typically is transported (e.g., by a Navy person) to the location of the vehicle 10 and then coupled to the vehicle 10. The box 54 can be brought to wherever the vehicle 10 resides including to its location on a ship or in a aircraft from which the vehicle 10 is to be launched. The box 54 is coupled to the vehicle 10 via a communications link 58, preferably a serial data link. The box 54 provides serial data translation (e.g., within the palmtop computer 62 itself or by a separate serial electronics module 63) to allow the palmtop computer 62 to interface with optical and/or diode couplers (not shown) within the vehicle 10. The box 54 generally can download operational parameters to the vehicle 10 via the link 58 and/or determine what parameters are already stored in the vehicle 10.

The box 54 also has another connection 60 to the vehicle. This connection 60 couples the box's internal battery/charger 64 to the vehicle 10. The battery/charger 64 preferably is a rechargeable battery. The vehicle 10 generally will require power to receive the download of operational parameters stored in the box 54. That is, because the vehicle 10 typically is not in operation (i.e., is not in the ocean simulating a submarine) when the box 54 is coupled thereto, the vehicle 10 is not activated or powered up via its own internal battery 36 (FIG. 2), and therefore it generally cannot receive or process any data. While it is possible to design the system 50 such that the vehicle 10 does use its own internal battery 36, it generally is preferable to conserve that battery 36 for the vehicle's in-ocean operations. In a preferred embodiment, the battery/charger 64 avoids overheating the vehicle 10 by shutting off power to the vehicle 10 after a predetermined period of time.

Figure 5:
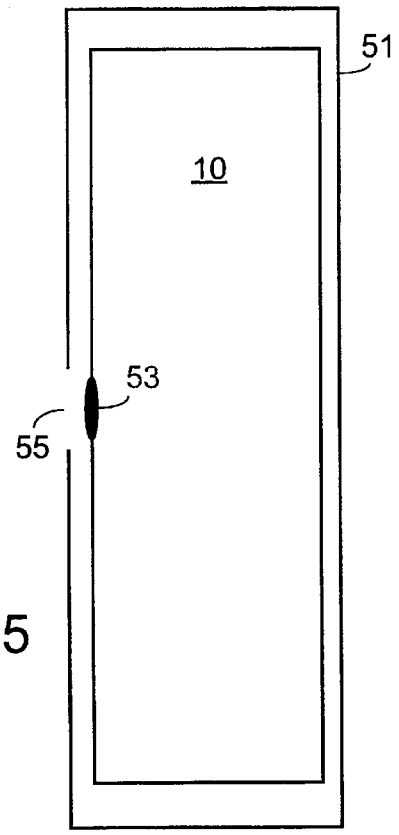
FIG. 5 is a block diagram of the expendable underwater vehicle packaged within a sonobuoy launch container.

Referring now also to FIG. 5, the expendable underwater vehicle 10 typically is shipped from the factory packaged within a sonobuoy launch container (SLC) 51. (As mentioned previously, an SLC can be used to air launch the vehicle 10.) The body of the vehicle 10 preferably has a through-hull connector 53 which is aligned with a hole 55 in the SLC 51 when the vehicle 10 is packed into the SLC 51. The through-hull connector 53 of the vehicle 10 is accessed by uncovering the hole 55 in the SLC 51 (e.g., by rolling aside or otherwise moving a rubber boot or adhesive-backed covering which is in or over the SLC's hole). The through-hull connector 53 of the vehicle 10 is for coupling to the data and power lines 58, 60 of the portable interface box 54. As mentioned previously, the vehicle preferably has optical and/or diode couplers. These couplers are for preventing any damage to electronics in the vehicle 10 which support the power and data link 58, 60 connections to the box 54.

With the field programmable system 50 according to the invention, a user in the field can program the vehicle 10 to perform a variety of different functions and/or take a variety of different actions. Examples of the types of things that the vehicle 10 can be made to do via field programmability and the types of operational parameters that can be downloaded into the vehicle 10 are described below.

The field programmable system 50 can be used to download run geometry information, variable speed information, variable tonal level information, evasive maneuver information, and/or pinger information to the vehicle 10. As shown in FIG. 3, the vehicle 10 can include a pinger subsystem 66, a signal processing subsystem 68, and a propulsion subsystem 70.

The guidance and control functions of the vehicle 10 can be performed by an electronic microcomputer 74 which can be located in the electronics 44 (FIG. 2). In a preferred embodiment, a microprocessor, such as an Intel 87C51FX, performs the functions of the electronic microcomputer 74. The course implemented by the guidance and control subsystem is programmable via the field programmable system 50. A number of courses can be field programmed into the vehicle 10. These courses are also referred to as "run geometries".

With the variable speed capability, the vehicle can be field programmed with various run geometries and speed profiles. Each course can have a sequence of speed changes throughout the course. In the field, the run geometries and speed profiles are downloaded to the electronic microcomputer 74 via a serial link. The electronic microcomputer 74 stores this information in a memory 76 such as a non-volatile EEPROM memory. In operation, the electronic microcomputer 74 accesses the data in the memory 76 and uses it to control the vehicle's maneuvers. These maneuvers are field programmable depth, heading, and speed changes. In a preferred embodiment, up to twenty-two different maneuvers are associated with each run, and up to six different runs are possible. All of this data is stored in the memory 76. A run program selection switch 78 is provided on the vehicle exterior, and it can be used by a field user to select one of the six possible run geometries. In the preferred embodiment, three of the six allow a magnetic anomaly detector (MAD) function of the vehicle to be utilized and the other three are non-MAD. MAD refers to the vehicle's simulation of a magnetic signature of a submarine.

Table 1 shows an example of run geometry/speed profile data for a single run. The electronic microcomputer 74 sequentially executes each of the twenty-two maneuvers (indicated by the twenty-two rows or "segments" in the table) one at a time for the time specified until the cumulative exit time (CUM TIME) conditions are met or the maximum run time (e.g., three hours) is met.

TABLE 1

| SEG-MENT | DEPTH (feet) | HEADING (deg mag) | SPEED (knots) | TIME EXIT (minutes) | CUM TIME (minutes) |
|---|---|---|---|---|---|
| 1 | 75 | 25 | 2 | 10 | 10 |
| 2 | 75 | 25 | 3 | 10 | 20 |
| 3 | 150 | 70 | 4 | 10 | 30 |
| 4 | 150 | 70 | 5 | 10 | 40 |
| 5 | 225 | 115 | 6 | 10 | 50 |
| 6 | 225 | 115 | 7 | 10 | 60 |
| 7 | 300 | 160 | 8 | 10 | 70 |
| 8 | 300 | 160 | 9 | 10 | 80 |
| 9 | 375 | 205 | 10 | 10 | 90 |
| 10 | 375 | 205 | 9.5 | 10 | 100 |
| 11 | 450 | 250 | 8.5 | 10 | 110 |
| 12 | 450 | 250 | 7.5 | 10 | 120 |
| 13 | 525 | 295 | 6.5 | 10 | 130 |
| 14 | 525 | 295 | 5.5 | 10 | 140 |
| 15 | 600 | 340 | 4.5 | 10 | 150 |
| 16 | 600 | 340 | 3.5 | 10 | 160 |
| 17 | 525 | 25 | 2.5 | 10 | 170 |
| 18 | 525 | 25 | 2 | 10 | 180 |
| 19 | 450 | 70 | 3 | 10 | 180 |
| 20 | 450 | 70 | 4 | 10 | 180 |
| 21 | 75 | 115 | 5 | 10 | 180 |
| 22 | 75 | 205 | 6 | 10 | 180 |

With the variable tonal levels capability, the vehicle 10 varies the output levels (amplitudes) of the acoustic tones it projects into the ocean to simulate a submarine. This capability allows the vehicle to be programmed in the field with various run geometries and tonal levels (and speed profiles if the variable speed capability is also utilized). In the field, the tonal levels, and usually the run geometries as well as the speed profiles, are downloaded to the microcomputer 74 via the serial link. The microcomputer stores this information in the memory 76. In operation, the microcomputer accesses the data in the memory 76 and uses it to control the tonal levels (and usually the vehicle maneuvers via the run geometry and/or speed profile data, which maneuvers preferably are field-programmable depth, heading, and speed changes). In a preferred embodiment, up to twenty-two different maneuvers are associated with each run, and up to six different runs are possible. All of this data is stored in the memory 76. The run program selection switch 78 is provided on the vehicle exterior. In a preferred embodiment, the tonal amplitude can change as a function of the switch 78 position.

Table 2 shows an example of run geometry and tonal level attenuation (and speed in this case) profile data for a single run. The microcomputer sequentially executes each of the twenty-two maneuvers (indicated by the twenty-two rows or "segments" in the table) one at a time for the time specified until the cumulative exit time (CUM) conditions are met or the maximum run time (e.g., three hours) is met.

TABLE 2

| SEG | DEPTH (feet) | HEAD-ING (dg mag) | SPEED (knots) | TONAL ATTN (dB) | TIME EXIT (mins) | CUM TIME (mins) |
|---|---|---|---|---|---|---|
| 1 | 75 | 25 | 2 | 40 | 10 | 10 |
| 2 | 75 | 25 | 3 | 30 | 10 | 20 |
| 3 | 150 | 70 | 4 | 25 | 10 | 30 |
| 4 | 150 | 70 | 5 | 20 | 10 | 40 |
| 5 | 225 | 115 | 6 | 15 | 10 | 50 |
| 6 | 225 | 115 | 7 | 10 | 10 | 60 |
| 7 | 300 | 160 | 8 | 6 | 10 | 70 |
| 8 | 300 | 160 | 9 | 3 | 10 | 80 |
| 9 | 375 | 205 | 10 | 0 | 10 | 90 |
| 10 | 375 | 205 | 9.5 | 2 | 10 | 100 |
| 11 | 450 | 250 | 8.5 | 4 | 10 | 110 |
| 12 | 450 | 250 | 7.5 | 8 | 10 | 120 |
| 13 | 525 | 295 | 6.5 | 12 | 10 | 130 |
| 14 | 525 | 295 | 5.5 | 17 | 10 | 140 |
| 15 | 600 | 340 | 4.5 | 22 | 10 | 150 |
| 16 | 600 | 340 | 3.5 | 27 | 10 | 160 |
| 17 | 525 | 25 | 2.5 | 35 | 10 | 170 |
| 18 | 525 | 25 | 2 | 40 | 10 | 180 |
| 19 | 450 | 70 | 3 | 30 | 10 | 180 |
| 20 | 450 | 70 | 4 | 25 | 10 | 180 |
| 21 | 75 | 115 | 5 | 20 | 10 | 180 |
| 22 | 75 | 205 | 6 | 15 | 10 | 180 |

Along with the run geometries, evasive maneuver information can be field-programmed into the vehicle. The vehicle also can be programmed in the field with speed profiles and/or variable tonal level information. All or any combination of this information can be downloaded in the field to the microcomputer 74 via the serial link. The microcomputer 74 stores this information in the memory 76, and then accesses and uses the information during in-water operation to control the vehicle's evasive maneuvers and other movement. These movements can include field-programmable depth, heading, and speed changes. Also, there can be tonal level variations throughout the course. The particular evasive maneuvers taken by the vehicle can be dictated by the position of the run program selection switch 78. The user can specify the particular evasive maneuvers and the relationship between them and switch 78 position, and the desired relationship can then be field-programmed into the vehicle by the user. Tables 3A and 3B show an example of "run geometry/speed profile/tonal level variations/evasive actions" data for a single run. As with Tables 1 and 2, each row ("segment") of Table 3A indicates actions which the vehicle will take and for how long. Tables 3A and 3B provided an example of user-specified evasive maneuver information.

TABLE 3A

| SEGMENT | RELATIVE DEPTH (feet) | RELATIVE HEADING (dg mag) | ABSOLUTE SPEED (knots) | ABSOLUTE TONAL ATTN (dB) | SEGMENT DURATION TIME (mins) | RELATIVE EXIT TIME (mins) |
|---|---|---|---|---|---|---|
| 1 | Table 3B | +45 | 2 | 40 | 2 | +2 |
| 2 | Table 3B | +45 | 2 | 40 | 3 | +5 |
| 3 | Table 3B | +45 | 2 | 40 | 2 | +7 |
| 4 | Table 3B | +45 | 2 | 40 | 4 | +11 |
| 5 | Table 3B | +45 | 2 | 40 | 2 | +13 |
| 6 | Table 3B | −45 | 10 | 0 | 2 | +15 |
| 7 | Table 3B | −45 | 10 | 0 | 2 | +17 |
| 8 | Table 3B | −45 | 10 | 0 | 2 | +19 |
| 9 | Table 3B | −45 | 10 | 0 | 2 | +21 |
| 10 | Table 3B | −45 | 10 | 0 | 2 | +23 |

TABLE 3B

| DEPTH INDEX | DEPTH (feet) | RELATIVE DEPTH (feet) |
|---|---|---|
| 0 | 75 | +525 |
| 1 | 150 | +450 |
| 2 | 225 | +375 |
| 3 | 300 | +300 |
| 4 | 375 | −300 |
| 5 | 450 | −375 |
| 6 | 525 | −450 |
| 7 | 600 | −525 |

The microcomputer 74 can be field-programmed with the desired pinger signal parameters via the serial link. In a preferred embodiment, the pinger signal parameters are as shown in Table 4. Definitions of the pinger signal parameters are provided after Table 4. The microcomputer 74 stores these pinger parameters in the memory 76. During in-water operation, the microcomputer 74 reads these parameters and uses them to generate the pinger signals via the pinger subsystem 66.

TABLE 4

| PARAMETER | ALLOCATION | UNITS | DE-FAULT |
|---|---|---|---|
| Pinger Enable/Disable | 1 bit | n/a | none |
| Pinger Type | 1 bit | n/a | none |
| Repetition Rate | 2 bits | table index | 0 |
| Target ID | 4 bits | table index | 0 |
| Repetition Rate Table | 4 bytes | integral # of 0.5 seconds | n/a |
| Pre-Ping Blanking | 1 byte | 1 millisecond | 5 |
| Short Post-Ping Blanking | 1 byte | 1 | 100 |
| Long Post-Ping Blanking | 1 byte | 1 | 250 |
| Pulse Width | 1 byte | 1 microsecond | 20 |
| Frequency | 1 byte | 1 microsecond | 54 or 57 |
| Frame Pulse Repetition Rate | 1 byte | integral # of 0.5 seconds | 16 |
| Number of Cycles/Base Pulse | 1 byte | cycles | 40 |
| Number of Cycles/Frame Pulse | 1 byte | cycles | 135 |
| Target ID Messages | 48 bytes | n/a | n/a |

The definitions of the pinger parameters from Table 4 are as follows.

Pinger Enable/Disable—This bit controls the execution of the pinger processes. When set, the loading of the remaining pinger parameters into program variables is continued. If not set, the pinger process is disabled.

Pinger Type—This bit selects either AUTEC pinger (a particular frequency ping) or the SOCAL pinger (a different frequency ping).

Repetition Rate—These two bits are an index into the Repetition Rate Table ($2^2$=four possible repetition rates).

Target ID—These four bits are an index into the Target ID Message Table ($4^2$=sixteen possible target IDs).

Repetition Rate Table—This four byte table stores the four possible repetition rates. Each repetition rate is expressed as an integral number of 0.5 second clock ticks. The range for each repetition rate is 0.5 seconds to 128 seconds.

Pre-Ping Blanking—This byte specifies the blanking time before the first ping pulse, and the units of this time are milliseconds with a range of 1 millisecond to 255 milliseconds.

Short Post-Ping Blanking—This byte specifies a short, post-ping blanking time, and the units are milliseconds with a range of 1 millisecond to 255 milliseconds. This parameter is used by the AUTEC pinger process only.

Long Post-Ping Blanking—This byte specifies a long, post-ping blanking time, and the units are milliseconds with a range of 1 millisecond to 255 milliseconds. This parameter is used by both the AUTEC and SOCAL pinger processes.

Pulse Width—This byte specifies the pulse width of a single cycle, and the units are microseconds with a range of 10 microseconds to 265 microseconds.

Frequency—This byte specifies the frequency of a single cycle, and it also specifies the low time of a single cycle. This parameter, in conjunction with the Pulse Width parameter, can be used to adjust the frequency of a single cycle. This parameter is expressed in microseconds with a range of 10 microseconds to 265 microseconds.

Frame Pulse Repetition Rate—This byte specifies the repetition rate of the frame pulse for the AUTEC pinger, and it is expressed as an integral number of 0.5 second clock ticks. The number of base pulses is a function of the Repetition Rate and the Frame Pulse Repetition Rate. The Frame Pulse Repetition Rate (when expressed as a period) must be greater than the Repetition Rate. The number of base pulses (NOBP) equals the quantity Frame Pulse Repetition Rate (FPRR) divided by Repetition Rate (RR) minus one: NOBP=(FPRR/RR)−1.

Number of Cycles per Base Pulse—This byte specifies the duration of an AUTEC pinger base (standard) pulse, and it is expressed as the number of cycles for a base (standard) pulse.

Number of Cycles per Frame Pulse—This byte specifies the duration of an AUTEC pinger frame pulse, and it is expressed as the number of cycles for a frame pulse.

Target ID Messages—This 48 byte linear array contains sixteen possible target ID messages. Only twelve of the sixteen messages are defined for the SOCAL pinger. The other four array elements are allocated for future expansion.

While FIG. 3 generally does not show connections to a power source for each of the components requiring power to operate, it should be understood that each such component is in fact connected to a source of power. For each component requiring power to operate, the battery 36 generally provides the necessary power thereto.

Variations, modifications, and other implementations of what is described herein will occur to those of ordinary skill in the art without departing from the spirit and the scope of the invention as claimed. Accordingly, the invention is to be defined not by the preceding illustrative description but instead by the following claims.

What is claimed is:

1. Apparatus for field programming a device used in training naval forces in anti-submarine warfare in ocean water, comprising:

(A) an expendable underwater vehicle having a length of about three to five feet and a diameter of about five inches, the vehicle including:

a nose at a front end of the vehicle, a shroud at a rear end of the vehicle which includes a propeller, elevators, and rudders, an internal motor for driving the propeller, actuators for controlling the elevators and the rudders, an internal guidance and control subsystem for storing and using a first set of operational parameters which dictate the operation of the vehicle in the ocean water, the internal guidance and control subsystem controlling the in-water operation of the vehicle by controlling the motor and the actuators based on the first set of operational parameters, a communications port coupled to the internal guidance and control subsystem, an internal signal processing subsystem for simulating a submarine by generating signals representative of the submarine and causing corresponding acoustic signals to be transmitted into the ocean water, and an internal power source for powering the signal processing subsystem, the guidance and control subsystem, the motor, and the actuators after launch of the vehicle into the ocean water; and (B) a portable interface module for coupling to the internal guidance and control subsystem via the communications port in the field prior to launch of the vehicle into the ocean water, the portable interface module being carryable by a single person and comprising a computer for storing and downloading to the internal guidance and control subsystem a second set of operational parameters to replace the first set of operational parameters, and a power source for providing power to at least the internal guidance and control subsystem of the vehicle to allow the internal guidance and control subsystem to receive and store the second set of operational parameters.

2. The apparatus of claim 1 further comprising a run geometry generator for coupling to the portable interface module to download thereto the second set of operational parameters.

3. The apparatus of claim 1 wherein the expendable underwater vehicle is housed within a sonobuoy launch container prior to launch of the vehicle into the ocean water, the sonobuoy launch container having a hole therein which is aligned with the communications port of the vehicle to allow the portable interface module to be coupled to the communications port through the hole in the sonobuoy launch container.

4. The apparatus of claim 1 wherein the power source in the portable interface module comprises a rechargeable power source.

5. The apparatus of claim 4 wherein the portable interface module has a weight of about 10 pounds.

6. The apparatus of claim 5 wherein the portable interface module has a size of about 0.5 cubic feet.

* * * * *